US011107422B2

(12) United States Patent
Lee et al.

(10) Patent No.: US 11,107,422 B2
(45) Date of Patent: Aug. 31, 2021

(54) DISPLAY DEVICE WITH DIFFERENT DRIVING FREQUENCIES FOR STILL AND MOVING IMAGES AND METHOD OF DRIVING THE SAME

(71) Applicant: SAMSUNG DISPLAY CO., LTD., Yongin-si (KR)

(72) Inventors: Hyo Jin Lee, Yongin (KR); Sangan Kwon, Cheonan-si (KR); Hui Nam, Suwon-si (KR); Jinyoung Roh, Hwaseong-si (KR); Sehyuk Park, Seongnam-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/800,122

(22) Filed: Feb. 25, 2020

(65) Prior Publication Data

US 2020/0349893 A1 Nov. 5, 2020

(30) Foreign Application Priority Data

May 2, 2019 (KR) ..... 10-2019-0051765

(51) Int. Cl.
*G09G 3/30* (2006.01)
*G09G 3/3291* (2016.01)

(52) U.S. Cl.
CPC ..... *G09G 3/3291* (2013.01); *G09G 2310/08* (2013.01); *G09G 2320/0247* (2013.01)

(58) Field of Classification Search
CPC ..... G06F 1/146; G06F 2320/0247; G06G 2340/0435; G09G 3/3618–3644
See application file for complete search history.

(56) References Cited

U.S. PATENT DOCUMENTS 9,530,380 B2 12/2016 Jang et al.
2015/0170609 A1* 6/2015 Jung ..... G09G 3/20 345/212
2015/0228216 A1* 8/2015 Lee ..... G09G 3/2029 345/691
2015/0294643 A1* 10/2015 Chen ..... G09G 5/026 345/589
2017/0018234 A1* 1/2017 Na ..... G09G 3/3406
2019/0244576 A1* 8/2019 Kwak ..... G09G 3/3655
2019/0287472 A1* 9/2019 Yang ..... G09G 3/3618

FOREIGN PATENT DOCUMENTS

KR 10-1651291 8/2016

* cited by examiner

*Primary Examiner* — Sanghyuk Park
(74) *Attorney, Agent, or Firm* — F. Chau & Associates, LLC

(57) ABSTRACT

A display device includes a display panel including a plurality of pixels and a display panel driver configured to drive the display panel. Here, the display panel driver is configured to receive input image data, to drive the display panel at a first driving frequency when the input image data corresponds to a moving image, and to select one of a plurality of flicker lookup tables based on the first driving frequency and drive the display panel at a second driving frequency based on the flicker lookup table when the input image data corresponds to a still image.

21 Claims, 9 Drawing Sheets

225

[REFERENCE FLICKER LUT@60Hz]

| GRAYSCALE | FLICKER VALUE | 2ND DRIVING FREQUENCY (2ND DF) |
|---|---|---|
| 0 | 1 | 1Hz |
| 1 | 1 | 1Hz |
| 2 | 1 | 1Hz |
| ⋮ | ⋮ | ⋮ |
| 15 | 11 | 30Hz |
| 16 | 11 | 30Hz |
| 17 | 11 | 30Hz |
| 18 | 7 | 10Hz |
| 19 | 7 | 10Hz |
| 20 | 5 | 5Hz |
| 21 | 2 | 2Hz |
| ⋮ | ⋮ | ⋮ |
| 253 | 1 | 1Hz |
| 254 | 1 | 1Hz |
| 255 | 1 | 1Hz |

×

226

[CONVERSION COEEFFICIENT LUT]

| 1ST DRIVING FREQUENCY (1ST DF) | CONVERSION COEFFICIENT (CC) |
|---|---|
| ⋮ | ⋮ |
| 30Hz | 2 |
| 60Hz | 1 |
| 90Hz | 0.7 |
| 120Hz | 0.5 |
| ⋮ | ⋮ |

=

227

[FLICKER LUT@120Hz]

| GRAYSCALE | FLICKER VALUE | 2ND DRIVING FREQUENCY (2ND DF) |
|---|---|---|
| 0 | 2 | 1Hz |
| 1 | 2 | 1Hz |
| 2 | 2 | 1Hz |
| ⋮ | ⋮ | ⋮ |
| 15 | 22 | 30Hz |
| 16 | 22 | 30Hz |
| 17 | 22 | 30Hz |
| 18 | 14 | 10Hz |
| 19 | 14 | 10Hz |
| 20 | 10 | 5Hz |
| 21 | 4 | 2Hz |
| ⋮ | ⋮ | ⋮ |
| 253 | 2 | 1Hz |
| 254 | 2 | 1Hz |
| 255 | 2 | 1Hz |

FIG. 5A

221

[1ST FLICKER LUT@60Hz]

| GRAYSCALE | FLICKER VALUE | 2ND DRIVING FREQUENCY (2ND DF) |
|---|---|---|
| 0 | 1 | 1Hz |
| 1 | 1 | 1Hz |
| 2 | 1 | 1Hz |
| ⋮ | ⋮ | ⋮ |
| 15 | 11 | 30Hz |
| 16 | 11 | 30Hz |
| 17 | 11 | 30Hz |
| 18 | 7 | 10Hz |
| 19 | 7 | 10Hz |
| 20 | 5 | 5Hz |
| 21 | 2 | 2Hz |
| ⋮ | ⋮ | ⋮ |
| 253 | 1 | 1Hz |
| 254 | 1 | 1Hz |
| 255 | 1 | 1Hz |

222

[2ND FLICKER LUT@120Hz]

| GRAYSCALE | FLICKER VALUE | 2ND DRIVING FREQUENCY (2ND DF) |
|---|---|---|
| 0 | 2 | 1Hz |
| 1 | 2 | 1Hz |
| 2 | 2 | 1Hz |
| ⋮ | ⋮ | ⋮ |
| 15 | 22 | 30Hz |
| 16 | 22 | 30Hz |
| 17 | 22 | 30Hz |
| 18 | 14 | 10Hz |
| 19 | 14 | 10Hz |
| 20 | 10 | 5Hz |
| 21 | 4 | 2Hz |
| ⋮ | ⋮ | ⋮ |
| 253 | 2 | 1Hz |
| 254 | 2 | 1Hz |
| 255 | 2 | 1Hz |

FIG. 5B

223

[1ST FLICKER LUT@60Hz~90Hz]

| GRAYSCALE | FLICKER VALUE | 2ND DRIVING FREQUENCY (2ND DF) |
|---|---|---|
| 0 | 1 | 1Hz |
| 1 | 1 | 1Hz |
| 2 | 1 | 1Hz |
| ⋮ | ⋮ | ⋮ |
| 15 | 11 | 30Hz |
| 16 | 11 | 30Hz |
| 17 | 11 | 30Hz |
| 18 | 7 | 10Hz |
| 19 | 7 | 10Hz |
| 20 | 5 | 5Hz |
| 21 | 2 | 2Hz |
| ⋮ | ⋮ | ⋮ |
| 253 | 1 | 1Hz |
| 254 | 1 | 1Hz |
| 255 | 1 | 1Hz |

224

[2ND FLICKER LUT@90Hz~120Hz]

| GRAYSCALE | FLICKER VALUE | 2ND DRIVING FREQUENCY (2ND DF) |
|---|---|---|
| 0 | 2 | 1Hz |
| 1 | 2 | 1Hz |
| 2 | 2 | 1Hz |
| ⋮ | ⋮ | ⋮ |
| 15 | 22 | 30Hz |
| 16 | 22 | 30Hz |
| 17 | 22 | 30Hz |
| 18 | 14 | 10Hz |
| 19 | 14 | 10Hz |
| 20 | 10 | 5Hz |
| 21 | 4 | 2Hz |
| ⋮ | ⋮ | ⋮ |
| 253 | 2 | 1Hz |
| 254 | 2 | 1Hz |
| 255 | 2 | 1Hz |

FIG. 5C

225

[REFERENCE FLICKER LUT@60Hz]

| GRAYSCALE | FLICKER VALUE | 2ND DRIVING FREQUENCY (2ND DF) |
|---|---|---|
| 0 | 1 | 1Hz |
| 1 | 1 | 1Hz |
| 2 | 1 | 1Hz |
| ⋮ | ⋮ | ⋮ |
| 15 | 11 | 30Hz |
| 16 | 11 | 30Hz |
| 17 | 11 | 30Hz |
| 18 | 7 | 10Hz |
| 19 | 7 | 10Hz |
| 20 | 5 | 5Hz |
| 21 | 2 | 2Hz |
| ⋮ | ⋮ | ⋮ |
| 253 | 1 | 1Hz |
| 254 | 1 | 1Hz |
| 255 | 1 | 1Hz |

×

226

[CONVERSION COEEFFICIENT LUT]

| 1ST DRIVING FREQUENCY (1ST DF) | CONVERSION COEFFICIENT (CC) |
|---|---|
| ⋮ | ⋮ |
| 30Hz | 2 |
| 60Hz | 1 |
| 90Hz | 0.7 |
| 120Hz | 0.5 |
| ⋮ | ⋮ |

=

227

[FLICKER LUT@120Hz]

| GRAYSCALE | FLICKER VALUE | 2ND DRIVING FREQUENCY (2ND DF) |
|---|---|---|
| 0 | 2 | 1Hz |
| 1 | 2 | 1Hz |
| 2 | 2 | 1Hz |
| ⋮ | ⋮ | ⋮ |
| 15 | 22 | 30Hz |
| 16 | 22 | 30Hz |
| 17 | 22 | 30Hz |
| 18 | 14 | 10Hz |
| 19 | 14 | 10Hz |
| 20 | 10 | 5Hz |
| 21 | 4 | 2Hz |
| ⋮ | ⋮ | ⋮ |
| 253 | 2 | 1Hz |
| 254 | 2 | 1Hz |
| 255 | 2 | 1Hz |

DISPLAY DEVICE WITH DIFFERENT DRIVING FREQUENCIES FOR STILL AND MOVING IMAGES AND METHOD OF DRIVING THE SAME

CROSS-REFERENCE TO RELATED APPLICATION

This application claims priority under 35 U.S.C. § 119 to Korean Patent Application No. 10-2019-0051765, filed on May 2, 2019 in the Korean Intellectual Property Office (KIPO), the disclosure of which is incorporated by reference herein in its entirety.

TECHNICAL FIELD

Exemplary embodiments of the inventive concept relate to a display device and a method of driving the display device.

DISCUSSION OF RELATED ART

Recently, various flat panel display devices with reduced weight and volume, as compared to conventional cathode ray tube (CRT) display devices, have been developed. Such flat panel display devices include liquid crystal displays (LCD), field emission displays (FED), plasma display panels (PDP), and organic light emitting displays (OLED).

Generally, a display device may include a display panel and a display panel driver. Here, when an image displayed on the display panel is a still image or when the display panel operates in an always-on mode (AOD), power consumption of the display device may be reduced by decreasing a driving frequency. However, when the driving frequency is decreased, flicker may be visible.

SUMMARY

According to an exemplary embodiment of the inventive concept, a display device may include a display panel including a plurality of pixels and a display panel driver configured to drive the display panel. The display panel driver may be configured to receive input image data, to drive the display panel at a first driving frequency when the input image data corresponds to a moving image, and to select one of a plurality of flicker lookup tables based on the first driving frequency and drive the display panel at a second driving frequency based on the selected flicker lookup table when the input image data corresponds to a still image.

In an exemplary embodiment of the inventive concept, each of the plurality of flicker lookup tables may store flicker values respectively corresponding to grayscales of the input image data that is driven at the first driving frequency and store the second driving frequency that is changed according to the flicker values.

In an exemplary embodiment of the inventive concept, the first driving frequency may be higher than the second driving frequency.

In an exemplary embodiment of the inventive concept, the display panel driver may include an image determiner configured to receive the input image data to determine whether the input image data corresponds to the moving image or the still image, a storage unit configured to store the plurality of flicker lookup tables, a selector configured to select one of the plurality of flicker lookup tables based on the first driving frequency, and a frequency determiner configured to determine the second driving frequency based on the selected flicker lookup table.

In an exemplary embodiment of the inventive concept, the selector may select one of the plurality of flicker lookup tables according to the first driving frequency.

In an exemplary embodiment of the inventive concept, the selector may select one of the plurality of flicker lookup tables according to a frequency band in which the first driving frequency is included.

In an exemplary embodiment of the inventive concept, the selector may receive the first driving frequency from an external device.

In an exemplary embodiment of the inventive concept, the selector may calculate the first driving frequency based on the input image data.

In an exemplary embodiment of the inventive concept, the selector may calculate the first driving frequency by counting a reference clock signal that is input during an active period of a vertical synchronization signal.

In an exemplary embodiment of the inventive concept, the display panel driver may store the plurality of flicker lookup tables during a manufacturing process of the display device.

In an exemplary embodiment of the inventive concept, the display panel driver may store a reference flicker lookup table corresponding to a reference driving frequency during a manufacturing process of the display device and may generate the plurality of flicker lookup tables by using a conversion coefficient for converting the reference flicker lookup table.

According to an exemplary embodiment of the inventive concept, a method of driving a display device may include receiving input image data, determining whether the input image data corresponds to a moving image or a still image, driving a display panel at a first driving frequency when the input image data corresponds to the moving image, selecting one of a plurality of flicker lookup tables based on the first driving frequency and determining a second driving frequency based on the selected flicker lookup table when the input image data corresponds to the still image, and driving the display panel at the second driving frequency when the input image data corresponds to the still image.

In an exemplary embodiment of the inventive concept, each of the plurality of flicker lookup tables may store flicker values respectively corresponding to grayscales of the input image data that is driven at the first driving frequency and store the second driving frequency that is changed according to the flicker values.

In an exemplary embodiment of the inventive concept, the first driving frequency may be higher than the second driving frequency.

In an exemplary embodiment of the inventive concept, the selected flicker lookup table may be selected according to the first driving frequency.

In an exemplary embodiment of the inventive concept, the selected flicker lookup table may be selected according to a frequency band in which the first driving frequency is included.

In an exemplary embodiment of the inventive concept, the first driving frequency may be provided from an external device.

In an exemplary embodiment of the inventive concept, the first driving frequency may be calculated based on the input image data.

In an exemplary embodiment of the inventive concept, the first driving frequency may be calculated by counting a reference clock signal that is input during an active period of a vertical synchronization signal.

In an exemplary embodiment of the inventive concept, the plurality of flicker lookup tables may be generated by using a conversion coefficient for converting a reference flicker lookup table corresponding to a reference driving frequency.

According to an exemplary embodiment of the inventive concept, a method of driving a display device may include receiving input image data, determining that the input image data corresponds to a still image, looking up an intermediary second driving frequency in a reference flicker lookup table according to a first driving frequency; looking up a conversion coefficient in a conversion coefficient lookup table according to the first driving frequency; determining a second driving frequency by multiplying the intermediary second driving frequency by the conversion coefficient; and driving the display panel at the second driving frequency.

BRIEF DESCRIPTION OF THE DRAWINGS

The above and other features of the inventive concept will be better understood by describing in detail exemplary embodiments thereof with reference to the accompanying drawings.

FIGS. 5A to 5C are diagrams illustrating flicker lookup tables included in the display panel driver of FIG. 4 according to exemplary embodiments of the inventive concept.

DETAILED DESCRIPTION OF THE EMBODIMENTS

Figure 1:
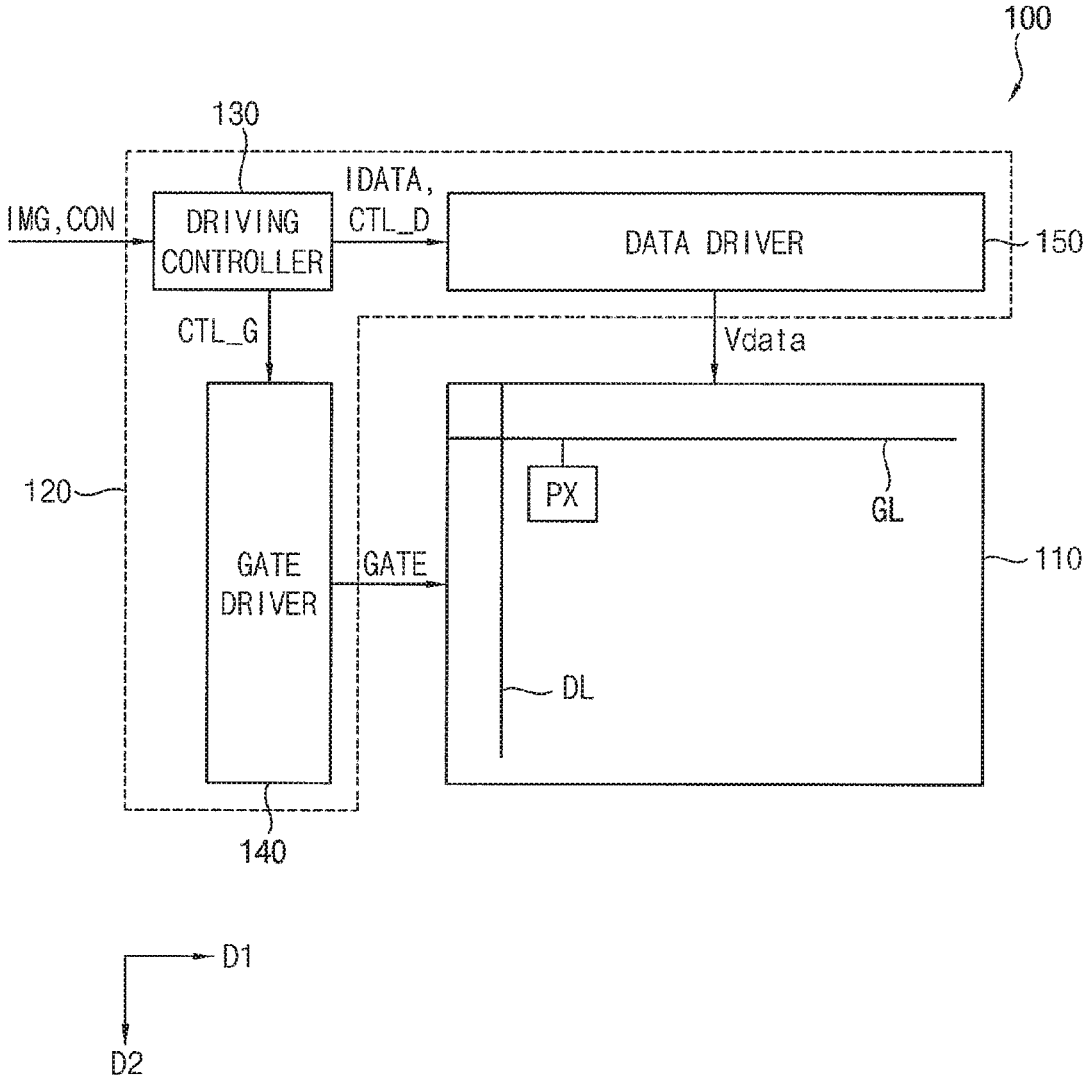
FIG. 1 is a block diagram illustrating a display device according to an exemplary embodiment of the inventive concept.

Exemplary embodiments of the inventive concept provide a display device that can reduce power consumption of a display panel and can improve display quality.

Exemplary embodiments of the inventive concept also provide a method of driving a display device that can reduce power consumption of a display panel and can improve display quality.

Hereinafter, exemplary embodiments of the inventive concept will be explained in detail with reference to the accompanying drawings. Like reference numerals may refer to like elements throughout this application.

Figure 2:
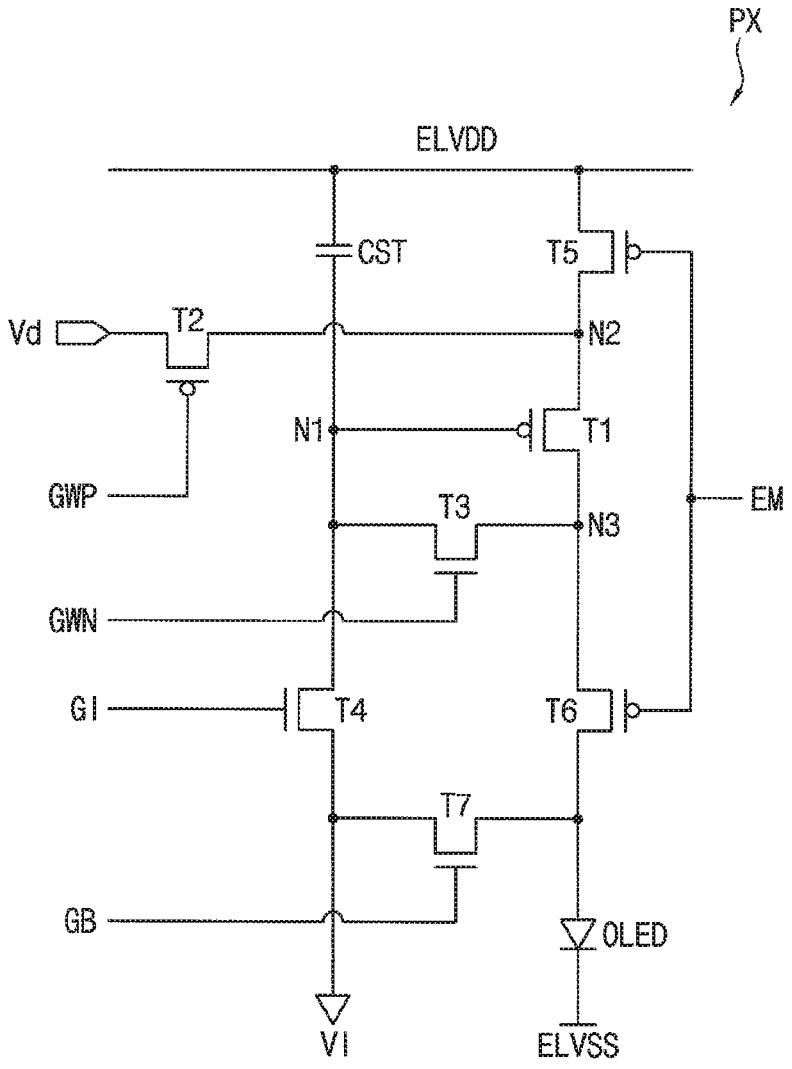
FIG. 2 is a circuit diagram illustrating a pixel included in the display device of FIG. 1 according to an exemplary embodiment of the inventive concept.

FIG. 1 is a block diagram illustrating a display device according to an exemplary embodiment of the inventive concept, and FIG. 2 is a circuit diagram illustrating a pixel included in the display device of FIG. 1 according to an exemplary embodiment of the inventive concept.

Referring to FIG. 1, a display device 100 may include a display panel 110 and a display panel driver 120.

The display panel 110 may include data lines DL, gate lines GL, and pixels PX. The gate lines GL may extend in a first direction D1 and may be arranged in a second direction D2 perpendicular to the first direction D1. The data lines DL may extend in the second direction D2 and may be arranged in the first direction D1. The first direction D1 may be substantially parallel to a long side of the display panel 110, and the second direction D2 may be substantially parallel to a short side of the display panel 110. Each of the pixels PX may be formed in an area where the data lines DL intersect the gate lines GL.

Referring to FIG. 2, each of the pixels PX may include a first-type switching element and a second-type switching element different from the first-type switching element. For example, the first-type switching element may be a polysilicon thin film transistor. For example, the first-type switching element may be a low temperature polysilicon (LTPS) thin film transistor. For example, the second-type switching element may be an oxide thin film transistor. For example, the first-type switching element may be a P-type transistor, and the second-type switching element may be an N-type transistor.

For example, data write gate signals GWP and GWN may include a first data write gate signal GWP and a second data write gate signal GWN. The first data write gate signal GWP may be applied to the P-type transistor and may have a low-level activation signal at a data write timing. The second data write gate signal GWN may be applied to the N-type transistor and may have a high-level activation signal at the data write timing.

Each of the pixels PX may include first to seventh switching elements T1, T2, T3, T4, T5, T6, and T7, a storage capacitor CST, and an organic light emitting diode OLED.

The first switching element T1 may include a gate electrode connected to a first node N1, a first electrode connected to a second node N2, and a second electrode connected to a third node N3. For example, the first switching element T1 may be a polysilicon thin film transistor. The first switching element T1 may be a P-type thin film transistor. The first electrode of the first switching element T1 may be a source electrode, and the second electrode of the first switching element T1 may be a drain electrode.

The second switching element T2 may include a gate electrode to which the first data write gate signal GWP is applied, a first electrode to which a data voltage Vd is applied, and a second electrode connected to the second node N2. For example, the second switching element T2 may be a polysilicon thin film transistor. The second switching element T2 may be a P-type thin film transistor. The first electrode of the second switching element T2 may be a source electrode, and the second electrode of the second switching element T2 may be a drain electrode.

The third switching element T3 may include a gate electrode to which the second data write gate signal GWN is applied, a first electrode connected to the first node N1, and a second electrode connected to the third node N3. For example, the third switching element T3 may be an oxide thin film transistor. The third switching element T3 may be an N-type thin film transistor. The first electrode of the third switching element T3 may be a source electrode, and the second electrode of the third switching element T3 may be a drain electrode.

The fourth switching element T4 may include a gate electrode to which a data initialization gate signal GI is applied, a first electrode to which an initialization voltage VI is applied, and a second electrode connected to the first node N1. For example, the fourth switching element T4 may be an oxide thin film transistor. The fourth switching element T4 may be an N-type thin film transistor. The first electrode of the fourth switching element T4 may be a source electrode, and the second electrode of the fourth switching element T4 may be a drain electrode.

The fifth switching element T5 may include a gate electrode to which an emission control signal EM is applied, a first electrode to which a high power supply voltage ELVDD is applied, and a second electrode connected to the second node N2. For example, the fifth switching element T5 may be a polysilicon thin film transistor. The fifth switching element T5 may be a P-type thin film transistor. The first electrode of the fifth switching element T5 may be a source electrode, and the second electrode of the fifth switching element T5 may be a drain electrode.

The sixth switching element T6 may include a gate electrode to which the emission control signal EM is applied, a first electrode connected to the third node N3, and a second electrode connected to an anode of the organic light emitting diode OLED. For example, the sixth switching element T6 may be a polysilicon thin film transistor. The sixth switching element T6 may be a P-type thin film transistor. The first electrode of the sixth switching element T6 may be a source electrode, and the second electrode of the sixth switching element T6 may be a drain electrode.

The seventh switching element T7 may include a gate electrode to which an organic light emitting diode initialization gate signal GB is applied, a first electrode to which the initialization voltage VI is applied, and a second electrode connected to the anode of the organic light emitting diode OLED. For example, the seventh switching element T7 may be an oxide thin film transistor. The seventh switching element T7 may be an N-type thin film transistor. The first electrode of the seventh switching element T7 may be a source electrode, and the second electrode of the seventh switching element T7 may be a drain electrode.

The storage capacitor CST may include a first electrode to which the high power supply voltage ELVDD is applied and a second electrode connected to the first node N1.

The organic light emitting diode OLED may include the anode and a cathode to which a low power supply voltage ELVSS is applied.

Although the pixel PX including the first-type switching element and the second-type switching element is described with reference to FIG. 2, the pixel PX included in the display panel 110 of FIG. 1 is not limited thereto. For example, the pixel PX included in the display panel 110 of FIG. 1 may include first to seventh first-type switching elements and capacitors or may include first to seventh second-type switching elements and capacitors.

The display panel driver 120 may generate a signal for driving the display panel 110 to supply the generated signal to the display panel 110. The display panel driver 120 may receive input image data IMG, may drive the display panel 110 at a first driving frequency when the input image data IMG corresponds to (or is for) a moving image, may select one of a plurality of flicker lookup tables based on the first driving frequency when the input image data IMG corresponds to (or is for) a still image, and may drive the display panel 110 at a second driving frequency based on the selected flicker lookup table when the input image data IMG corresponds to the still image. In this case, the first driving frequency may be a high frequency, and the second driving frequency may be a low frequency. In other words, the first driving frequency may be higher than the second driving frequency. In detail, the display panel driver 120 may include a driving controller 130, a gate driver 140, and a data driver 150.

The driving controller 130 may receive the input image data IMG and an input control signal CON from an external device. For example, the input image data IMG may include red image data, green image data, and blue image data. For example, the input image data IMG may include white image data. For example, the input image data IMG may include magenta image data, yellow image data, and cyan image data. The input control signal CON may include a master clock signal and a data enable signal. The input control signal CON may further include a vertical synchronization signal and a horizontal synchronization signal.

The driving controller 130 may generate a gate control signal CTL_G, a data control signal CTL_D, and an input data signal IDATA based on the input image data IMG and the input control signal CON. The driving controller 130 may generate the gate control signal CTL_G for controlling an operation of the gate driver 140 based on the input control signal CON and output the generated gate control signal CTL_G to the gate driver 140. The gate control signal CTL_G may include a vertical start signal and a gate clock signal. The driving controller 130 may generate the data control signal CTL_D for controlling an operation of the data driver 150 based on the input control signal CON. The data control signal CTL_D may include a horizontal start signal and a load signal. The driving controller 130 may generate the input data signal IDATA based on the input image data IMG. The driving controller 130 may output the input data signal IDATA to the data driver 150.

The gate driver 140 may generate gate signals GATE in response to the gate control signal CTL_G received from the driving controller 130. The gate driver 140 may output the gate signals GATE to the pixels PX connected to the gate lines GL.

The data driver 150 may generate an analog data voltage Vdata based on the data control signal CTL_D and the input data signal IDATA received from the driving controller 130. The data driver 150 may output the analog data voltage Vdata to the pixels PX connected to the data lines DL.

Figure 3:
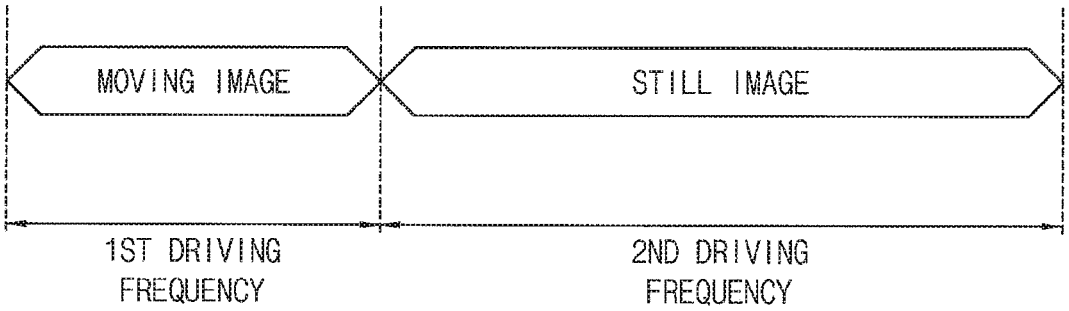
FIG. 3 is a diagram for describing an operation of a display panel driver included in the display device of FIG. 1 according to an exemplary embodiment of the inventive concept.
Figure 4:
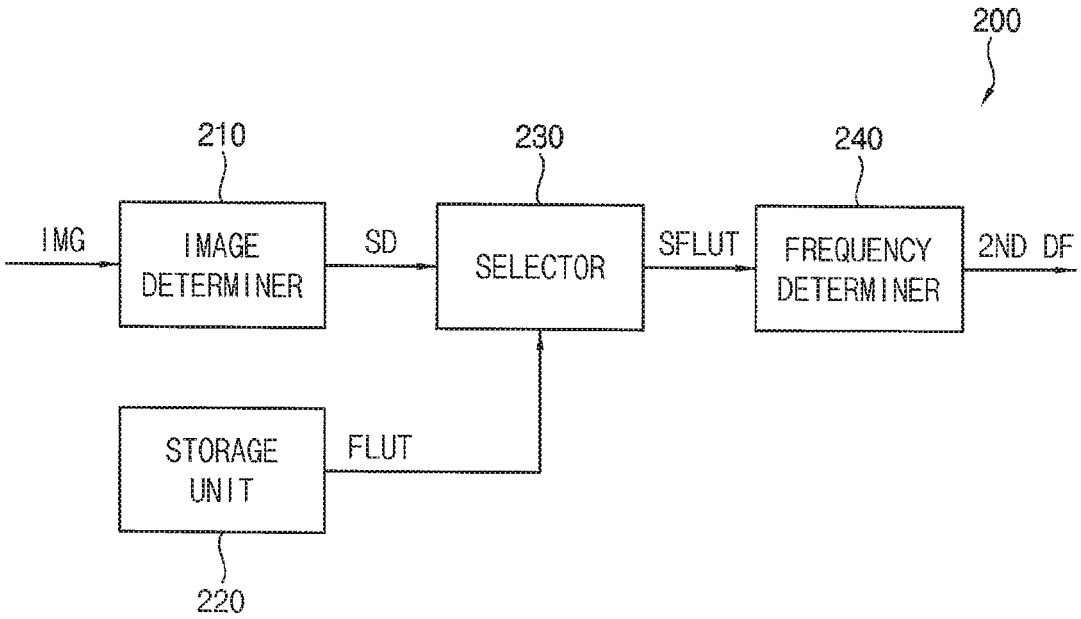
FIG. 4 is a block diagram illustrating a display panel driver included in the display device of FIG. 1 according to an exemplary embodiment of the inventive concept.

FIG. 3 is a diagram for describing an operation of a display panel driver included in the display device of FIG. 1 according to an exemplary embodiment of the inventive concept, FIG. 4 is a block diagram illustrating a display panel driver included in the display device of FIG. 1 according to an exemplary embodiment of the inventive concept, and FIGS. 5A to 5C are diagrams illustrating flicker lookup tables included in the display panel driver of FIG. 4 according to exemplary embodiments of the inventive concept.

Referring to FIG. 3, the display panel driver may drive the display panel at the first driving frequency when the input image data corresponds to a moving image and may drive the display panel at the second driving frequency when the input image data corresponds to a still image. In this case, the second driving frequency may be determined based on the flicker lookup table selected based on the first driving frequency.

Referring to FIG. 4, a display panel driver 200 may include an image determiner 210, a storage unit 220, a selector 230, and a frequency determiner 240. The display panel driver 200 of FIG. 4 may correspond to the display panel driver 120 of FIG. 1. For example, the image determiner 210, the storage unit 220, the selector 230, and the frequency determiner 240 may be included in the display panel driver 120 of FIG. 1.

The image determiner 210 may receive the input image data IMG and may determine whether the input image data IMG corresponds to a moving image or a still image. When the input image data IMG corresponds to the still image, the image determiner 210 may output a still image determination signal SD.

The storage unit 220 may store a plurality of flicker lookup tables FLUT. Each of the flicker lookup tables FLUT may store respective flicker values corresponding to grayscales (or gray-levels) of the input image data IMG driven at the first driving frequency and store the second driving frequency changed according to the flicker value. The flicker value may indicate a degree of flicker occurring in each of the grayscales, and the second driving frequency may be a lowest frequency at which the flicker is not viewed or visible. The flicker value and the second driving frequency corresponding to the flicker value may be determined by an external evaluation, and the flicker lookup tables FLUT may be stored in the storage unit 220 during a manufacturing process of the display device.

Referring to FIG. 5A, the storage unit 220 may include a first flicker lookup table 221 and a second flicker lookup table 222. Each of the first flicker lookup table 221 and the second flicker lookup table 222 may store respective flicker values FLICKER VALUE corresponding to grayscales GRAYSCALE of the input image data IMG driven at different first driving frequencies and a second driving frequency 2ND DF changed according to the flicker value. For example, the first flicker lookup table 221 may store flicker values respectively corresponding to the grayscales of the input image data IMG at the first driving frequency of 60 Hz and the second driving frequency 2ND DF, and the second flicker lookup table 222 may store flicker values respectively corresponding to the grayscales of the input image data IMG at the first driving frequency of 120 Hz and the second driving frequency 2ND DF.

Referring to FIG. 5B, the storage unit 220 may include a first flicker lookup table 223 and a second flicker lookup table 224. Each of the first flicker lookup table 223 and the second flicker lookup table 224 may store respective flicker values corresponding to the grayscales of the input image data IMG driven at first driving frequencies within different frequency bands and the second driving frequency 2ND DF changed according to the flicker value. For example, the first flicker lookup table 223 may store respective flicker values corresponding to the grayscales of the input image data IMG at the first driving frequency which is greater than or equal to 60 Hz and less than 90 Hz and the second driving frequency 2ND DF, and the second flicker lookup table 224 may store respective flicker values corresponding to the grayscales of the input image data IMG at the first driving frequency which is greater than or equal to 90 Hz and less than 120 Hz and the second driving frequency 2ND DF.

Although the storage unit 220 configured to store the first flicker lookup tables 221 and 223 and the second flicker lookup tables 222 and 224 is described with reference to FIGS. 5A and 5B, the storage unit 220 may further store flicker lookup tables in addition to the first flicker lookup tables 221 and 223 and the second flicker lookup tables 222 and 224.

Referring to FIG. 5C, the storage unit 220 may include a reference flicker lookup table 225 and a conversion coefficient lookup table 226. The reference flicker lookup table 225 may store respective flicker values corresponding to the grayscales of the input image data IMG driven at a reference frequency and the second driving frequency 2ND DF changed according to the flicker value. For example, the reference flicker lookup table 225 may store respective flicker values corresponding to the grayscales of the input image data IMG at the reference frequency of 60 Hz and the second driving frequency 2ND DF. The conversion coefficient lookup table 226 may include conversion coefficients CC for converting the reference flicker lookup table 225 according to a first driving frequency 1ST DF. The storage unit 220 may generate a plurality of flicker lookup tables based on the reference flicker lookup table 225 and the conversion coefficient lookup table 226.

For example, the storage unit 220 may generate a second flicker lookup table 227 by multiplying the second driving frequency 2ND DF of the reference flicker lookup table 225 by the conversion coefficient CC. For example, when the reference flicker lookup table 225 stores the flicker values corresponding to the grayscales of the input image data IMG at the reference frequency of 60 Hz and the second driving frequency 2ND DF and when the first driving frequency 1ST DF of the input image data IMG is 120 Hz, the flicker value of the second flicker lookup table 227 may be two times the reference flicker lookup table 225, and the second driving frequency 2ND DF may be generated according to the flicker value. However, in this case, the second driving frequency 2ND DF may be set too high, so that a power consumption reduction effect obtained by low-frequency driving may be reduced.

Therefore, the second flicker lookup table 227 that stores the second driving frequencies 2ND DF respectively corresponding to the grayscales of the input image data IMG at 120 Hz may be generated by multiplying the second driving frequency 2ND DF (e.g., an intermediary second driving frequency), which is increased by double according to the flicker value, by the conversion coefficient CC of 0.5 included in the conversion coefficient lookup table 226.

Referring back to FIG. 4, the selector 230 may select one of the flicker lookup tables FLUT based on the first driving frequency. According to an exemplary embodiment of the inventive concept, the selector 230 may receive the first driving frequency of the input image data IMG from the external device. According to an exemplary embodiment of the inventive concept, the selector 230 may calculate the first driving frequency based on the input image data IMG. In this case, the selector 230 may calculate the first driving frequency by counting a reference clock signal which is input during an active period of the vertical synchronization signal. The selector 230 may select one of the flicker lookup tables FLUT stored in the storage unit 220 according to the first driving frequency. For example, the selector 230 may select one of the first flicker lookup tables 221 and 223 or the reference flicker lookup table 225 shown in FIGS. 5A to 5C when the first driving frequency is 60 Hz, and the selector 230 may select one of the second flicker lookup tables 222, 224, and 227 shown in FIGS. 5A to 5C when the first driving frequency is 120 Hz. The selector 230 may output a flicker lookup table SFLUT, selected based on the first driving frequency, to the frequency determiner 240.

The frequency determiner 240 may determine the second driving frequency 2ND DF based on the flicker lookup table SFLUT selected by the selector 230. For example, when the first driving frequency is 60 Hz, the selector 230 may select one of the first flicker lookup tables 221 and 223 or the reference flicker lookup table 225 shown in FIGS. 5A to 5C to supply the selected flicker lookup table to the frequency determiner 240.

The frequency determiner 240 may determine the second driving frequencies 2ND DF respectively corresponding to the grayscales of the input image data IMG based on one of the first flicker lookup tables 221 and 223 or the reference flicker lookup table 225 shown in FIGS. 5A to 5C. For example, when the input image data IMG has fifteen grayscales, the frequency determiner 240 may determine the second driving frequency 2ND DF as 30 Hz based on one of the first flicker lookup tables 221 and 223 or the reference flicker lookup table 225 shown in FIGS. 5A to 5C.

For example, when the first driving frequency is 120 Hz, the selector 230 may select one of the second flicker lookup tables 222, 224, and 227 shown in FIGS. 5A to 5C to supply the selected flicker lookup table to the frequency determiner 240. The frequency determiner 240 may determine the second driving frequencies 2ND DF respectively corresponding to the grayscales of the input image data IMG based on one of the second flicker lookup tables 222, 224, and 227 shown in FIGS. 5A to 5C. For example, when the input image data IMG has the fifteen grayscales, the frequency determiner 240 may determine the second driving frequency 2ND as 30 Hz based on one of the second flicker lookup tables 222, 224, and 227 shown in FIGS. 5A to 5C.

As described above, the display panel driver 200 of the display device may store the flicker lookup tables FLUT, may select one of the flicker lookup tables FLUT according to the first driving frequency of the input image data IMG, and may determine the second driving frequency 2ND DF based on the selected flicker lookup table SFLUT, so that the still image can be displayed at an optimal low frequency. Therefore, power consumption of the display device can be reduced, and display quality can be improved.

Figure 6:
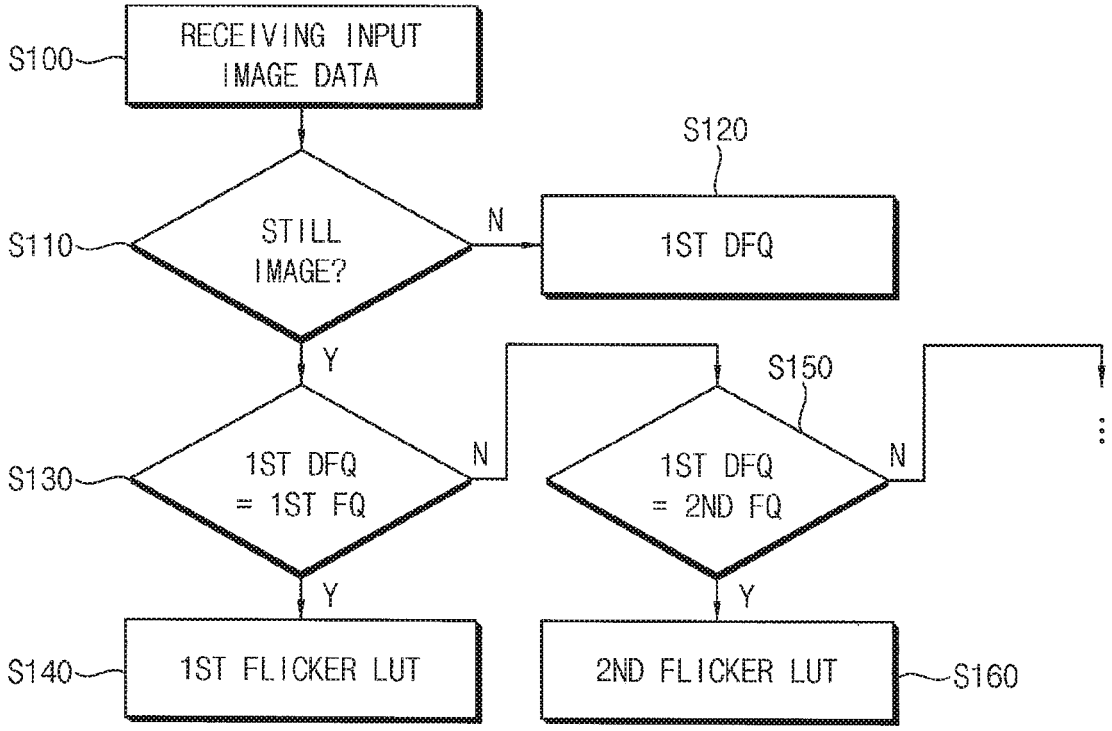
FIG. 6 is a flowchart illustrating an operation of a display panel driver included in the display device of FIG. 1 according to an exemplary embodiment of the inventive concept.

FIG. 6 is a flowchart illustrating an operation of a display panel driver included in the display device of FIG. 1 according to an exemplary embodiment of the inventive concept.

Referring to FIG. 6, the display panel driver may receive input image data (S100). The display panel driver may determine whether the input image data corresponds to a moving image or a still image (S110). When the input image data corresponds to the moving image (e.g., does not correspond to the still image), the display panel driver may drive the display panel at the first driving frequency (S120). When the input image data corresponds to the still image, the display panel driver may determine whether the first driving frequency of the input image data is the same as a first frequency (S130).

When the first driving frequency of the input image data is the same as the first frequency, the display panel driver may select the first flicker lookup table (S140). When the first driving frequency of the input image data is not the same as the first frequency, the display panel driver may determine whether the first driving frequency of the input image data is the same as a second frequency (S150). When the first driving frequency of the input image data is the same as the second frequency, the display panel driver may select the second flicker lookup table (S160). Although a case where the display panel driver includes the first flicker lookup table and the second flicker lookup table is described with reference to FIG. 6, when the display panel driver includes more flicker lookup tables, the display panel driver may compare the first driving frequency of the input image data with frequencies of the flicker lookup tables to select the flicker lookup table having a frequency equal to the first driving frequency.

Figure 7:
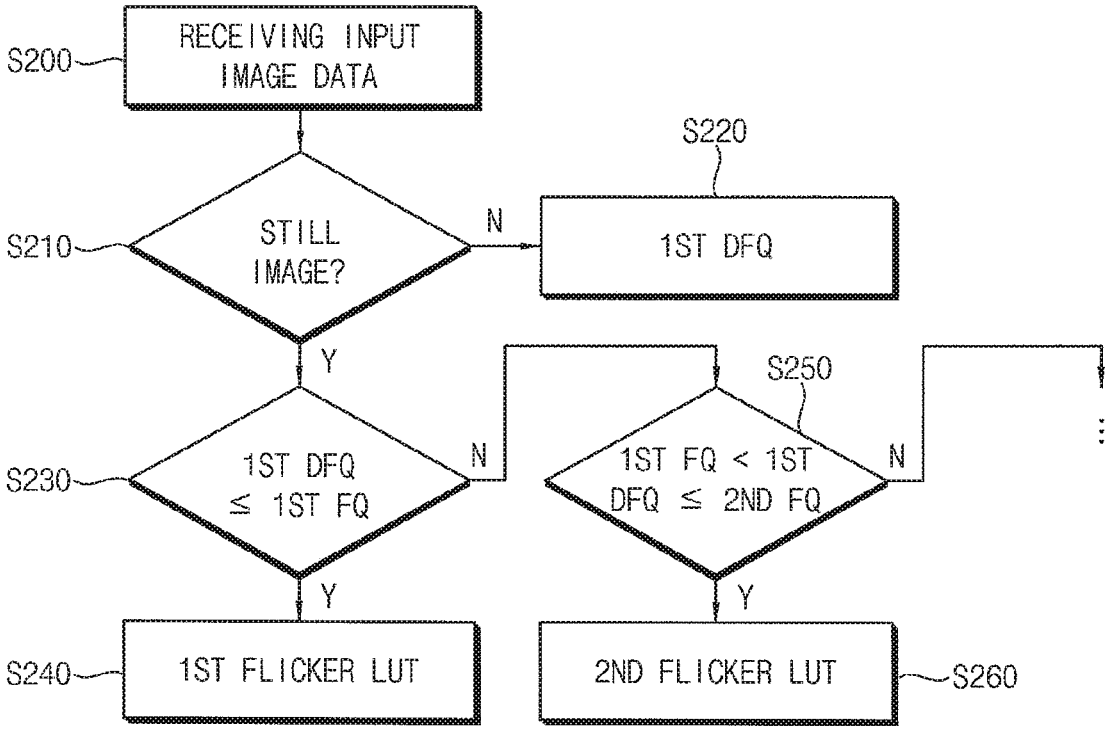
FIG. 7 is a flowchart illustrating an operation of a display panel driver included in the display device of FIG. 1 according to an exemplary embodiment of the inventive concept.

FIG. 7 is a flowchart illustrating an operation of a display panel driver included in the display device of FIG. 1 according to an exemplary embodiment of the inventive concept.

Referring to FIG. 7, the display panel driver may receive input image data (S200). The display panel driver may determine whether the input image data corresponds to a moving image or a still image (S210). When the input image data corresponds to the moving image (e.g., does not correspond to the still image), the display panel driver may drive the display panel at the first driving frequency (S220). When the input image data corresponds to the still image, the display panel driver may determine whether the first driving frequency of the input image data is less than or equal to the first frequency (S230).

When the first driving frequency of the input image data is less than or equal to the first frequency, the display panel driver may select the first flicker lookup table (S240). When the first driving frequency of the input image data is greater than the first frequency, the display panel driver may determine whether the first driving frequency of the input image data is less than or equal to the second frequency (S250). When the first driving frequency of the input image data is greater than the first frequency and less than or equal to the second frequency, the display panel driver may select the second flicker lookup table (S260). Although a case where the display panel driver includes the first flicker lookup table and the second flicker lookup table is described with reference to FIG. 7, when the display panel driver includes more flicker lookup tables, the display panel driver may compare the first driving frequency of the input image data with frequency bands of the flicker lookup tables to select the flicker lookup table having a frequency band in which the first driving frequency is included.

Figure 8:
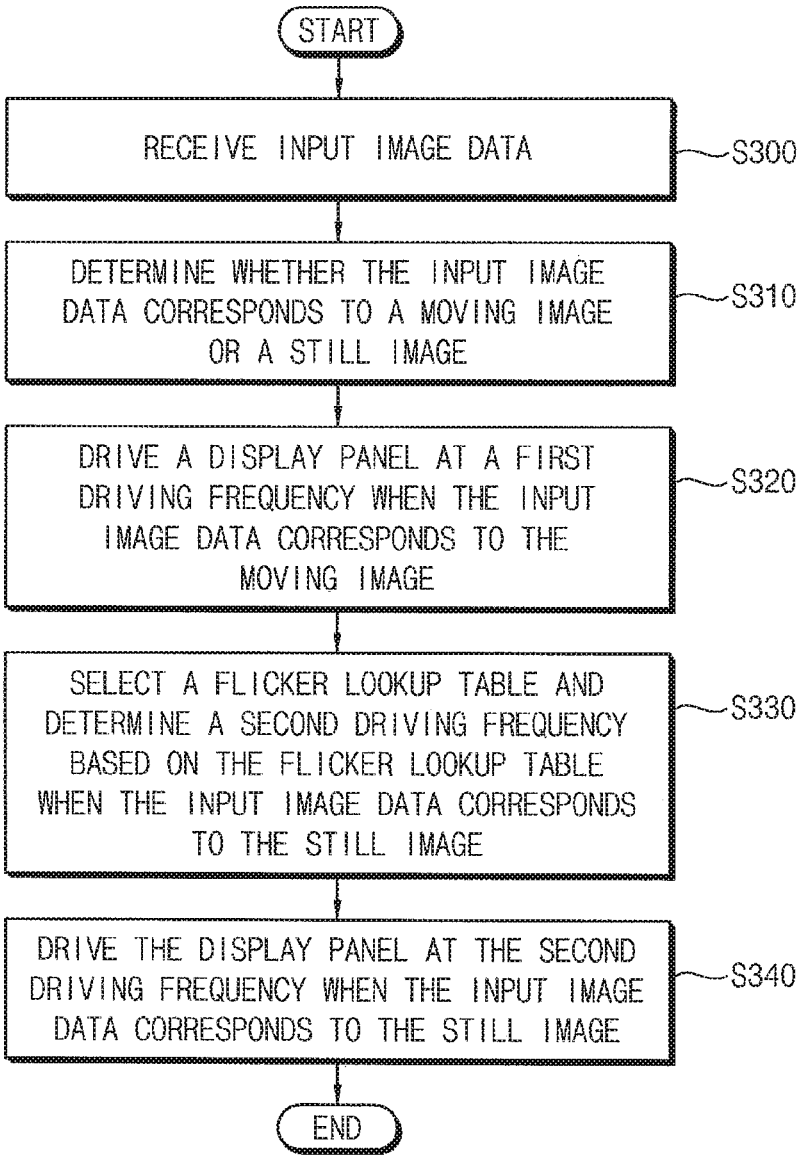
FIG. 8 is a flowchart illustrating a method of driving a display device according to an exemplary embodiment of the inventive concept.

FIG. 8 is a flowchart illustrating a method of driving a display device according to an exemplary embodiment of the inventive concept.

Referring to FIG. 8, operations of the method of FIG. 8 may receive input image data (S300), may determine whether the input image data corresponds to a moving image or a still image (S310), may drive a display panel at a first driving frequency when the input image data corresponds to the moving image (S320), may select a flicker lookup table and determine a second driving frequency based on the flicker lookup table when the input image data corresponds to the still image (S330), and may drive the display panel at the second driving frequency when the input image data corresponds to the still image (S340).

For example, in operation S300, the display panel driver of the display device may receive the input image data from the external device.

In operation S310, the display panel driver of the display device may determine whether the input image data corresponds to the moving image or the still image to output a still image determination signal when the input image data corresponds to the still image.

In operation S320, the display panel driver of the display device may drive the display panel at the first driving frequency when the input image data corresponds to the moving image. In this case, the first driving frequency may be a high frequency.

In operation S330, the display panel driver of the display device may select one of a plurality of flicker lookup tables based on the first driving frequency and determine the second driving frequency based on the selected flicker lookup table when the input image data corresponds to the still image. The display panel driver of the display device may store the flicker lookup tables. Each of the flicker lookup tables may store the flicker values corresponding to the grayscales of the input image data driven at the first driving frequency and the second driving frequency changed according to the flicker value. The flicker value may indicate the degree of flicker occurring in each of the grayscales, and the second driving frequency may be the lowest frequency at which flicker is not viewed. The flicker value and the second driving frequency corresponding to the flicker value may be determined by an external evaluation, and the flicker lookup tables may be stored in the storage unit during the manufacturing process of the display device.

In an exemplary embodiment of the inventive concept, the display panel driver of the display device may store a plurality of flicker lookup tables corresponding to the first driving frequency. In an exemplary embodiment of the inventive concept, the display panel driver of the display device may store a plurality of flicker lookup tables corresponding to a frequency band in which the first driving frequency is included. In an exemplary embodiment of the inventive concept, the display panel driver of the display device may include the reference flicker lookup table and the conversion coefficient lookup table and may generate a plurality of flicker lookup tables by selecting a conversion coefficient according to the first driving frequency and performing a calculation by using the reference flicker lookup table and the conversion coefficient.

The display panel driver of the display device may select one of the flicker lookup tables based on the first driving frequency. In an exemplary embodiment of the inventive concept, the first driving frequency may be input from the external device. In an exemplary embodiment of the inventive concept, the first driving frequency may be calculated based on the input image data. For example, the first driving frequency may be calculated by counting the reference clock signal which is input during the active period of the vertical synchronization signal. The display panel driver of the display device may select one of the flicker lookup tables stored in the storage unit according to the first driving frequency. The display panel driver may determine the second driving frequencies respectively corresponding to the grayscales of the input image data based on the selected flicker lookup table.

In operation S340, the display panel driver of the display device may drive the display panel at the second driving frequency when the input image data corresponds to the still image. In this case, the second driving frequency may be a low frequency.

As described above, according to the method of FIG. 8, a plurality of flicker lookup tables are stored, one of the flicker lookup tables is selected according to the first driving frequency of the input image data, and the second driving frequency is determined based on the selected flicker lookup table, so that the still image can be displayed at an optimal low frequency. Therefore, power consumption of the display device can be reduced, and display quality can be improved.

The inventive concept may be applied to any electronic device including a display device. For example, the inventive concept may be applied to a television, a computer monitor, a laptop, a digital camera, a cellular phone, a smart phone, a smart pad, a tablet personal computer (PC), a personal digital assistant (PDA), a portable multimedia player (PMP), an MP3 player, a car navigation system, a video phone, a head mounted display (HMD) device, etc.

As described above, a display device and a method of driving a display device according to exemplary embodiments of the inventive concept may display a still image at an optimal low frequency by storing a plurality of flicker lookup tables, by selecting one of the flicker lookup tables according to a first driving frequency of input image data, and by determining a second driving frequency based on the selected flicker lookup table. Thus, power consumption of the display device may be reduced, and display quality may be improved.

While the inventive concept has been shown and described with reference to exemplary embodiments thereof, it will be apparent to those of ordinary skill in the art that various modifications in form and details may be made thereto without departing from the spirit and scope of the inventive concept as set forth by the appended claims.

What is claimed is:

1. A display device comprising:

a display panel including a plurality of pixels; and a display panel driver configured to drive the display panel, wherein the display panel driver is configured to receive input image data, to drive the display panel at a first driving frequency when the input image data corresponds to a moving image, and to select a flicker lookup table from among a plurality of flicker lookup tables based on the first driving frequency and drive the display panel at a second driving frequency based on the selected flicker lookup table when the input image data corresponds to a still image, wherein each of the plurality of flicker lookup tables stores candidates for the second driving frequency, which respectively correspond to grayscales of the input image data that is driven at the first driving frequency, and wherein the display panel driver determines one of the candidates as the second driving frequency based on the selected flicker lookup table.

2. The display device of claim 1, wherein the each of the plurality of flicker lookup tables further stores flicker values respectively corresponding to the candidates which respectively correspond to the grayscales of the input image data that is driven at the first driving frequency.

3. The display device of claim 1, wherein the first driving frequency is higher than the second driving frequency.

4. The display device of claim 1, wherein the display panel driver includes:

an image determiner configured to receive the input image data to determine whether the input image data corresponds to the moving image or the still image;

a storage unit configured to store the plurality of flicker lookup tables;

a selector configured to select one of the plurality of flicker lookup tables based on the first driving frequency; and a frequency determiner configured to determine the second driving frequency based on the selected flicker lookup table.

5. The display device of claim 4, wherein the selector selects one of the plurality of flicker lookup tables according to the first driving frequency.

6. The display device of claim 4, wherein the selector selects one of the plurality of flicker lookup tables according to a frequency band in which the first driving frequency is included.

7. The display device of claim 4, wherein the selector receives the first driving frequency from an external device.

8. The display device of claim 4, wherein the selector calculates the first driving frequency based on the input image data.

9. The display device of claim 8, wherein the selector calculates the first driving frequency by counting a reference clock signal that is input during an active period of a vertical synchronization signal.

10. The display device of claim 1, wherein the display panel driver stores the plurality of flicker lookup tables during a manufacturing process of the display device.

11. The display device of claim 1, wherein the display panel driver stores a reference flicker lookup table corresponding to a reference driving frequency during a manufacturing process of the display device and generates the plurality of flicker lookup tables by using a conversion coefficient for converting the reference flicker lookup table.

12. A method of driving a display device comprising:

receiving input image data;

determining whether the input image data corresponds to a moving image or a still image;

driving a display panel at a first driving frequency when the input image data corresponds to the moving image;

selecting a flicker lookup table from among a plurality of flicker lookup tables based on the first driving frequency and determining a second driving frequency based on the selected flicker lookup table when the input image data corresponds to the still image; and driving the display panel at the second driving frequency when the input image data corresponds to the still image, wherein each of the plurality of flicker lookup tables stores candidates for the second driving frequency, which respectively correspond to grayscales of the input image data that is driven at the first driving frequency, and wherein one of the candidates is determined as the second driving frequency based on the selected flicker lookup table.

13. The method of claim 12, wherein the each of the plurality of flicker lookup tables further stores flicker values respectively corresponding to candidates which respectively correspond to the grayscales of the input image data that is driven at the first driving frequency.

14. The method of claim 12, wherein the first driving frequency is higher than the second driving frequency.

15. The method of claim 12, wherein the selected flicker lookup table is selected according to the first driving frequency.

16. The method of claim 12, wherein the selected flicker lookup table is selected according to a frequency band in which the first driving frequency is included.

17. The method of claim 12, wherein the first driving frequency is provided from an external device.

18. The method of claim 12, wherein the first driving frequency is calculated based on the input image data.

19. The method of claim 18, wherein the first driving frequency is calculated by counting a reference clock signal that is input during an active period of a vertical synchronization signal.

20. The method of claim 12, wherein the plurality of flicker lookup tables are generated by using a conversion coefficient for converting a reference flicker lookup table corresponding to a reference driving frequency.

21. A method of driving a display device comprising:

receiving input image data;

determining that the input image data corresponds to a still image;

looking up an intermediary second driving frequency in a reference flicker lookup table according to a first driving frequency;

looking up a conversion coefficient in a conversion coefficient lookup table according to the first driving frequency;

determining a second driving frequency by multiplying the intermediary second driving frequency by the conversion coefficient; and driving a display panel at the second driving frequency.

* * * * *